US009869212B2

(12) United States Patent
Xu

(10) Patent No.: US 9,869,212 B2
(45) Date of Patent: Jan. 16, 2018

(54) COLUMNAR HYDRAULIC TAPPET

(71) Applicant: HANGZHOU XZB TECH CO., LTD., Hangzhou, Zhejiang Province (CN)

(72) Inventor: Na Xu, Hangzhou (CN)

(73) Assignee: HANGZHOU XZB TECH CO., LTD., Hangzhou (CN)

( * ) Notice: Subject to any disclaimer, the term of this patent is extended or adjusted under 35 U.S.C. 154(b) by 98 days.

(21) Appl. No.: 15/025,068

(22) PCT Filed: Feb. 26, 2015

(86) PCT No.: PCT/CN2015/073281
§ 371 (c)(1),
(2) Date: Mar. 25, 2016

(87) PCT Pub. No.: WO2016/090757
PCT Pub. Date: Jun. 16, 2016

(65) Prior Publication Data

US 2016/0298502 A1 Oct. 13, 2016

(30) Foreign Application Priority Data

Dec. 11, 2014 (CN) ..... 2014 2 0785649 U

(51) Int. Cl.

| | |
|---|---|
| ***F01P 1/04*** | (2006.01) |
| ***F01L 1/245*** | (2006.01) |
| ***F01L 1/16*** | (2006.01) |
| ***F01L 1/14*** | (2006.01) |
| ***F01L 1/18*** | (2006.01) |
| ***F01L 1/24*** | (2006.01) |

(52) U.S. Cl.
CPC ..... *F01L 1/245* (2013.01); *F01L 1/14* (2013.01); *F01L 1/16* (2013.01); *F01L 1/185* (2013.01); *F01L 1/2405* (2013.01)

(58) Field of Classification Search
CPC ..... F01L 1/14; F01L 1/16; F01L 1/185; F01L 1/245; F01L 1/2405
USPC ..... 123/90.35, 90.39, 90.44, 90.45, 90.46
See application file for complete search history.

(56) References Cited

U.S. PATENT DOCUMENTS

| | | | | |
|---|---|---|---|---|
| 6,325,034 | B1 | 12/2001 | Edelmayer | |
| 8,490,590 | B2 * | 7/2013 | Kubota | F01L 1/185 123/90.45 |
| 2013/0025555 | A1 | 1/2013 | Kretschmer et al. | |

FOREIGN PATENT DOCUMENTS

| | | | |
|---|---|---|---|
| CN | 200999632 | Y | 1/2008 |
| CN | 203783666 | U | 8/2014 |

(Continued)

*Primary Examiner* — Ching Chang
(74) *Attorney, Agent, or Firm* — Jiwen Chen

(57) ABSTRACT

A columnar hydraulic tappet comprises a housing, in which a plunger is correspondingly mounted. A high-pressure chamber extends between a lower end surface of the plunger and a lower side of the housing. An outer ring groove is disposed on the outer diameter of the housing, an inner ring groove is disposed in the radial inner side of the housing, and housing oil feed holes are disposed between the inner ring groove and the outer ring groove. The lower end inside the housing is provided with a grinding wheel groove, an upper end wall of the inner ring groove of the housing is a first internal cylindrical wall, and a housing inner-wall between the lower end of the inner ring groove of the housing and the grinding wheel groove is a second internal cylindrical wall.

3 Claims, 3 Drawing Sheets

(56) References Cited

FOREIGN PATENT DOCUMENTS

| | | | |
|---|---|---|---|
| CN | 104131852 | A | 11/2014 |
| DE | 102008037180 | A1 | 2/2010 |
| WO | WO2010023748 | A1 | 3/2010 |

* cited by examiner

COLUMNAR HYDRAULIC TAPPET

This is a U.S. national stage application of PCT Application No. PCT/CN2015/073281 under 35 U.S.C. 371, filed Feb. 26, 2015 in Chinese, claiming the priority benefit of Chinese Application No. 2014207856494, filed Dec. 11, 2014, which is hereby incorporated by reference.

FIELD OF THE INVENTION

The present invention pertains to the field of engine fittings manufacturing technologies, and in particular to a columnar hydraulic tappet that can automatically compensate a valve working clearance.

BACKGROUND OF THE INVENTION

The use of roller rocker arms and a valve mechanism of a hydraulic tappet in an overhead cam engine structure is increasingly widespread, compared with a valve mechanism of a mechanical tappet, it has the following advantages:

1) real-time compensation of valve clearance, not requiring a periodic manual adjustment;

2) reducing engine noise and shock;

3) lighter volume mass, smaller friction, smaller movement inertia meaning less energy loss, conducive to improving engine efficiency; and 4) longer service life of components and parts of the valve mechanism, and reduced maintenance cost.

The columnar hydraulic tappet has a can-shaped housing. In the housing, it is matched with a plunger that axially moves relatively to the housing, a high-pressure chamber for a hydraulic medium is formed between a lower end surface of the plunger and a bottom of the housing, and the high-pressure chamber can be sealed by means of a check valve opened towards the high-pressure chamber. The high-pressure chamber is internally provided with a reset spring which acts between the lower end surface of the plunger and the housing. The housing is provided with an oil hole for hydraulic medium circulation. The oil hole is communicated, at a radial inner side of the housing, with an oil feed hole of the plunger. An oil storage chamber for storing hydraulic medium is formed between the oil feed hole of the plunger and the check valve. An external cylindrical surface at the lower end of the plunger is matched with an internal cylindrical surface at the lower end of the housing to form a leak-down sealing region therebetween, which has a certain length and a certain clearance, so as to ensure the columnar hydraulic tappet has a certain leak-down feature.

When the engine stopped working for some time, the hydraulic tappet is pressurized at a lower position, a part of the hydraulic medium in the high-pressure chamber is discharged. When the engine is started, the hydraulic medium supplied by an oil pump needs some time to reach the hydraulic tappet. During this period, a valve clearance exists. The plunger of the hydraulic tappet moves upward under the action of the reset spring, so that a negative pressure is formed in the high-pressure chamber. The check valve is opened, and the hydraulic medium in the oil storage chamber is sucked into the high-pressure chamber. The hydraulic tappet is gradually restored to a working height, and the valve clearance disappears. If oil in the oil storage chamber is insufficient, air is sucked into the high-pressure chamber, and supporting stiffness of the hydraulic tappet is substantially reduced, which causes abnormal engine sound, increases noise, and accelerates wear of related parts.

A Chinese Patent Document CN102767405 discloses a hydraulic support element, as shown in FIG. 1. A plunger of this structure comprises an upper and a lower plunger bodies. A leak-down sealing region is formed between an external cylindrical surface of the lower plunger body and an internal cylindrical surface of the housing by means of fitting, while the upper plunger body mainly plays a role in guiding. A fit clearance between the external cylindrical surface of the upper plunger body and the internal cylindrical surface of the housing is slightly larger, which tends to slightly tilting in the working process. Therefore, in order to ensure that when the hydraulic tappet is compressed downward from the working height, the upper plunger body does not stagnate on an internal and round step surface of the housing. A guiding length of the upper plunger body in an inner hole of the housing is spacially limited. A height dimension of the lower plunger body shall not be too long. It shall ensure that when the hydraulic tappet is at the working height, the lower end surface of the upper plunger body is lower than the internal and round step surface at the lower end of the oil hole of the housing. Because the height dimension of the lower plunger body is limited, and the length of the leak-down sealing region is also limited, the clearance value of the leak-down sealing region cannot be too large, the requirements for cylindricity of the housing and the plunger are higher, which increases the processing difficulties. In addition, the hydraulic tappet of this structure has a grinding wheel groove with a certain width on the internal cylindrical surface of the housing thereof. Therefore, in the process when the hydraulic tappet is compressed from its working height to a minimum position, the length of the leak-down sealing region is gradually reduced, thereby causing inconsistency of leak-down time within a working stroke. In order to ensure enough sealing length, the grinding wheel groove of the housing of this structure can only be designed relatively narrowly. In an internal cylindrical shaping and grinding procedure, the front end of a grinding wheel is easy to wear because it is a dead hole grinding, it is possible that the diameter of an inner hole at the upper end of the grinding wheel groove, i.e., near the bottom of the inner hole, may become slightly smaller, which may cause clamping stagnation of the plunger and even function failure of the product lacking sufficient clearance. A split-type plunger structure needs to be processed respectively, thus the manufacturing cost is relatively high. Particular requirements for runout of the contact end face of two plunger bodies are very high. If the runout is out of tolerance, a lateral force may be generated, further possibly causing the plunger is clamped and stagnated in the housing, thereby affecting the use function of the product.

SUMMARY OF THE INVENTION

The object of the present invention is to provide a one-piece plunger-type columnar hydraulic tappet having full working stroke and stable leak-down feature, where the plunger has a one-piece structure, simple in structure and good in guiding, capable of reducing a risk of clamping stagnation between the plunger and the housing, and convenient for assembly. The external cylindrical surface at the lower end of the one-piece plunger has a longer length, and a length of the leak-down sealing region formed between the external cylindrical surface and an internal cylindrical surface of the housing is longer, the clearance value of the leak-down sealing region can be properly enlarged, and the risk of clamping stagnation of the plunger due to dirt of engine oil is reduced. The grinding wheel groove inside the housing of this structure has a larger width, which is greater than or equal to a working stroke. In the whole working stroke of the hydraulic tappet, the length of the leak-down sealing region is basically unchanged, and the leak-down time is basically consistent. Meanwhile, the grinding wheel groove has a larger width, which improves a grinding process performance and reduces the risk of clamping stagnation of the plunger.

In order to achieve the above object, the present invention adopts a specific technical solution as below:

A columnar hydraulic tappet, comprising a housing, where a plunger that axially moves relatively to the housing is correspondingly mounted in the housing, a high-pressure chamber for a hydraulic medium extends between a lower end surface of the plunger and a lower side of the housing, and the high-pressure chamber can be sealed by means of a check valve opened towards the high-pressure chamber; an outer ring groove for hydraulic medium circulation is disposed on the outer diameter of the housing, an inner ring groove for hydraulic medium circulation is disposed in the radial inner side of the housing, and one or more housing oil feed holes are disposed between the inner ring groove and the outer ring groove; the lower end inside the housing is provided with a grinding wheel groove, an upper end wall of the inner ring groove of the housing is a first internal cylindrical wall, and a housing inner-wall between the lower end of the inner ring groove of the housing and the grinding wheel groove is a second internal cylindrical wall; a lower part of a head of the plunger is provided with a first ring groove, and a middle part of the plunger is provided with a second ring groove. A plunger middle wall is disposed between the first ring groove and the second ring groove, where the second ring groove is a concave and wide ring groove, the plunger middle wall is provided with at least one oil feed holes communicated with the second ring groove, a cylindrical wall at the lower end of the concave and wide ring groove of the plunger is a plunger lower wall, and a leak-down sealing region for leaking the hydraulic medium is formed between the second internal cylindrical wall of the housing and the plunger lower wall; and a stroke of the plunger running from a working height to a minimum compression height is a working stroke of the hydraulic tappet.

It is found through research by the inventor that the length and the clearance value of the leak-down sealing region formed between the plunger and the housing by fitting directly affect the leak-down feature of the hydraulic tappet. Because it is a dead hole grinding, the width of the grinding wheel groove inside the housing directly affects the processing quality of the housing inner-wall. The front end of a grinding wheel is easy to wear if the width of the grinding wheel groove is too narrow because it is a dead hole grinding, so it is possible that the diameter of an inner hole at the upper end of the grinding wheel groove, i.e., near the bottom of the inner hole, may become slightly smaller, which may cause clamping stagnation of the plunger and even function failure of the product without enough clearance.

The plunger is a one-piece structure, simple in structure and convenient for assembly, and has a good guiding for fitting with the housing, thereby avoiding the risk of clamping stagnation between the split-type plunger structure and the housing.

The width of the grinding wheel groove of the housing is enlarged, which improves a grinding process performance and reduces the risk of clamping stagnation of the plunger.

Preferably, the width of the grinding wheel groove of the housing is $\delta$, the working stroke of the plunger is h, according to a test result, $\delta \geq h$.

The length dimension a of the plunger lower wall of the plunger is larger and is not less than a sum of the width $\delta$ of the grinding wheel groove and a length L of the leak-down sealing region, i.e., $a \geq \delta + L$.

When the plunger is at a working height, the upper end of the grinding wheel groove of the housing is not less than the lower end surface of the plunger. In the process when the plunger runs from a working height to a minimum compression height, the length L of the leak-down sealing region formed between the plunger lower wall and the second internal cylindrical wall of the housing remains unchanged basically. L is approximately equal to the length of the second internal cylindrical wall of the housing, and the leak-down time is basically consistent, thereby improving the leak-down stability of the hydraulic tappet in the whole working stroke.

The length of the leak-down sealing region formed between the plunger lower wall and the second internal cylindrical wall of the housing is longer, and the clearance value of the leak-down sealing region can be properly broadened when it does not affect the leak-down performance of the hydraulic tappet, which reduces the risk of clamping stagnation of the plunger due to dirty engine oil.

The plunger first uses an integrated cold-heading processing technology to form a plunger blank, then uses a roller forming process to pre-form a plunger neck and an concave and wide ring groove, and finally uses an on-line lamination process to punch a plunger oil feed hole. The forming process is simple and the processing efficiency is high.

One or more plunger oil feed holes and oil grooves are distributed on a peripheral direction of the plunger. When multiple oil feed holes and oil grooves are provided, they can be arbitrarily arranges on the peripheral direction of the plunger.

Compared with a hydraulic tappet disclosed in comparative literatures, the present invention has the beneficial effects as below:

The plunger of the present invention has a one-piece structure, simple in structure and good in guiding, capable of reducing a risk of clamping stagnation between the plunger and the housing, and convenient for assembly. The housing has a wider grinding wheel groove, whose width is greater than a working stroke. In the whole working stroke of the hydraulic tappet, the length of the leak-down sealing region is basically unchanged, and the leakdown time is basically consistent. Meanwhile, the grinding wheel groove has a larger width, which improves a grinding process performance and reduces the risk of clamping stagnation of the plunger.

1. The plunger of the present invention has a one-piece structure. The plunger of the existing structure has a one-piece structure, comprises an upper and a lower plunger bodies. In order to avoid a risk of clamping stagnation between the upper plunger body and the housing, while a guiding length of the upper plunger body in an inner hole of the housing is spacially limited, a height dimension of the lower plunger body shall not be too long. It shall ensure that when the hydraulic tappet is at the working height, the lower end surface of the upper plunger body is lower than the internal and round step surface at the lower end of the oil hole of the housing. Because the height dimension of the lower plunger body is limited, and the length of the leak-down sealing region is also limited, the clearance value of the leak-down sealing region cannot be too large, the requirements for cylindricity of the housing and the plunger are higher, which increases the processing difficulties. The two plunger bodies of the split-type plunger need to be processed respectively, and requirements for runout of the contact end face of the two plunger bodies are very high. If the runout is out of tolerance, a lateral force may be generated, thereby causing clamping stagnation of the plunger. The one-piece plunger structure of the present invention overcomes defects of an existing plunger structure, simple in structure and good in guiding, capable of reducing the risk of clamping stagnation between the plunger and the housing, and convenient for assembly. The external cylindrical surface at the lower end of the one-piece plunger has a longer length, and the length of the leak-down sealing region formed between the external cylindrical surface and the internal cylindrical surface of the housing is longer, the clearance value of the leak-down sealing region can be properly enlarged, and the risk of clamping stagnation of the plunger due to dirty engine oil is reduced.

2. The grinding wheel groove inside the housing of the present invention has a larger width. The grinding wheel groove inside the housing of the existing structure has a narrower width. In an internal grinding procedure, the front end of a grinding wheel is easy to wear because it is a dead hole grinding. It is possible that the diameter of an inner hole at the upper end of the grinding wheel groove, i.e., near the bottom of the inner hole, may become slightly smaller, which may cause clamping stagnation of the plunger and even function failure of the product lacking enough clearance. In the process when the plunger is compressed from its working height to a minimum position, the length of the leak-down sealing region is gradually reduced, thereby causing inconsistency of leak-down time within a working stroke. The width of the grinding wheel groove of the housing of the present invention is greater than or equal to a working stroke of the hydraulic tappet. In the whole working stroke of the hydraulic tappet, the length of the leak-down sealing region is basically unchanged, and the leak-down time is basically consistent. Meanwhile, the grinding wheel groove has a larger width, which improves a grinding process performance and reduces the risk of clamping stagnation of the plunger.

DRAWING NUMBER DESCRIPTION

Figure 1:
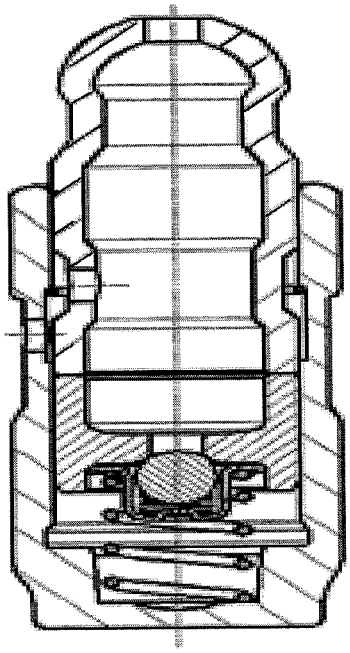
FIG. 1 (Prior Art)
FIG. 1 is a schematic structural diagram of a hydraulic tappet in the prior art when it is at a working height.
Figure 2:
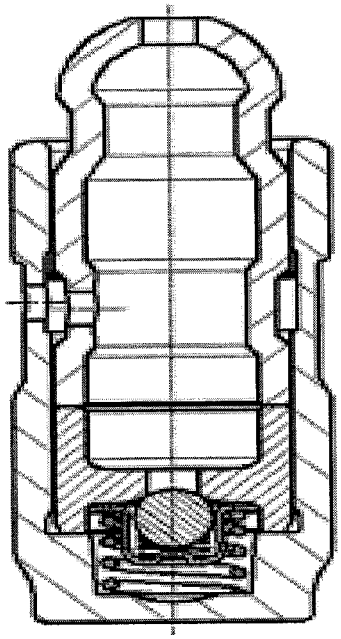
FIG. 2 (Prior Art)
FIG. 2 is a schematic structural diagram of a hydraulic tappet in the prior art when it is at the minimum compression height.

1 plunger
2 housing
3 check valve
4 reset spring
5 concave and wide ring groove of the plunger
6 oil feed hole of the plunger
7 oil hole of the housing
8 inner ring groove of the housing
9 oil storage chamber
10 high-pressure chamber
11 head of the plunger
12 outer ring groove of the housing
13 plunger neck (first ring groove)
14 grinding wheel groove of the housing
15 plunger lower wall
16 first internal cylindrical wall of the housing
17 second internal cylindrical wall of the housing
18 leak-down sealing region
19 limiting clamp spring

DETAILED DESCRIPTION OF THE EMBODIMENTS

The following further describes the present invention with reference to the accompanying drawings.

Embodiment 1

Figure 4:
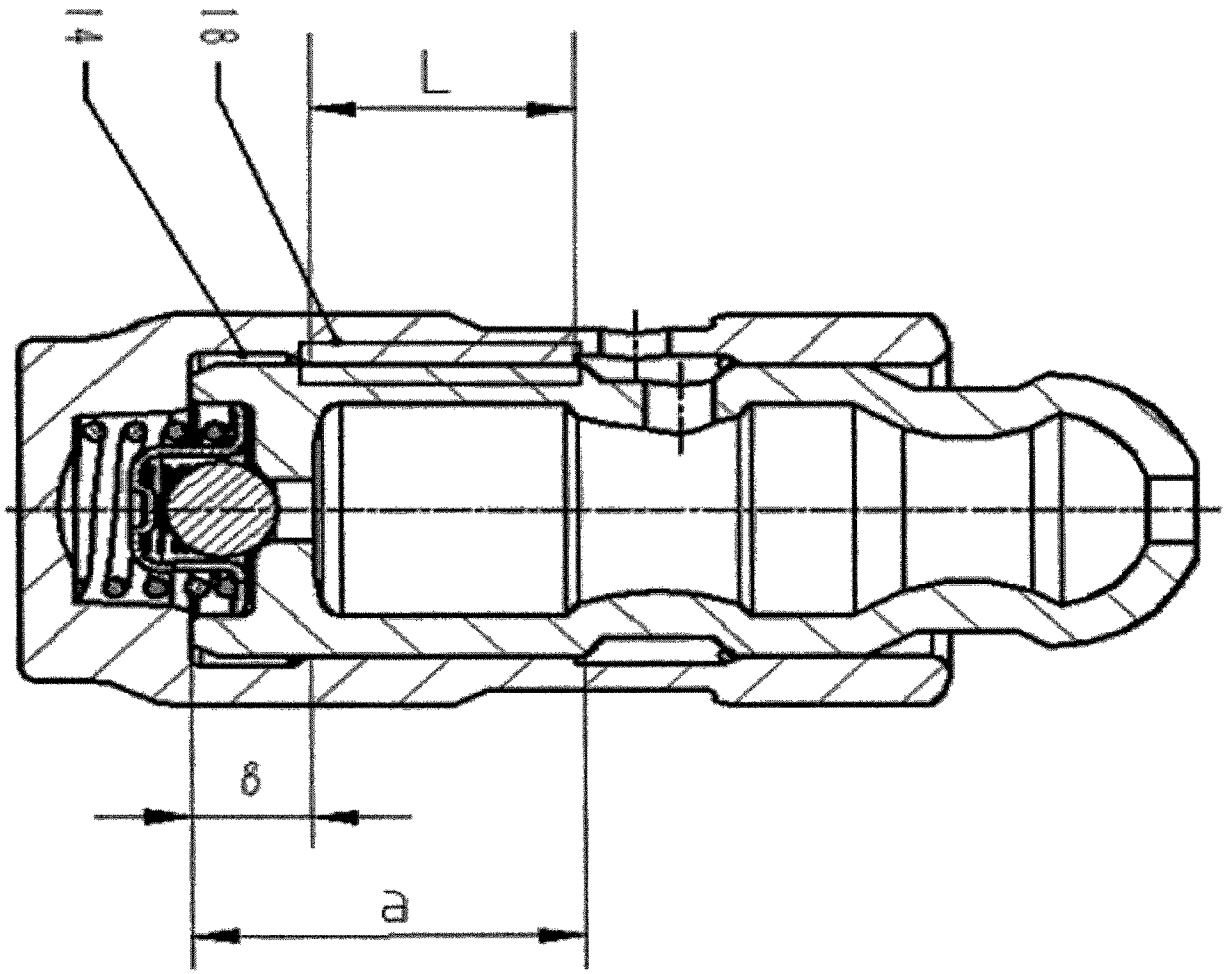
FIG. 4 is a schematic structural diagram of a hydraulic tappet according to an embodiment of the present invention when it is at the minimum compression height.

As shown in FIG. 4, a columnar hydraulic tappet for a valve mechanism of an engine has a can-shaped housing 2. In the housing 2, there is provided with a plunger 1 that can axially slides. A high-pressure chamber 10 is disposed between a lower end surface of the plunger 1 and the housing 2, and the high-pressure chamber 10 can be sealed by means of a check valve 3 positioned at the lower end of the plunger 1, and the high-pressure chamber 10 has a reset spring 4 connected with the plunger 1 and the housing 2. An outer ring groove 12 of the housing for hydraulic medium circulation is disposed on the outer diameter of the housing 2, an inner ring groove 8 of the housing for hydraulic medium circulation is disposed in the radial inner side of the housing 2, and one or more oil holes 7 for hydraulic medium circulation are disposed between the inner ring groove 8 of the housing and the outer ring groove 12 of the housing; an upper end inner-wall of the inner ring groove 8 of the housing is a first internal cylindrical wall 16, a lower end inner-wall of the inner ring groove 8 of the housing is a second internal cylindrical wall 17 of the housing, and at the lower end of the second internal cylindrical wall 17 of the housing there is provided with a grinding wheel groove 14 convenient for blind hole processing. On the outer diameter of the plunger 1 there is provided with a concave and wide ring groove 5 for hydraulic medium circulation, on a vertical wall of the plunger above the concave and wide ring groove 5 there is provided with one or more circumferentially distributed plunger oil feed holes 6, the inner ring groove 8 of the housing is communicated with the concave and wide ring groove 5 of the plunger, and the concave and wide ring groove 5 of the plunger is communicated with the plunger oil feed holes 6. The hydraulic medium enters from the outer ring groove 12 of the housing to the oil storage chamber 9 of the plunger. Between the concave and wide ring groove 5 of the plunger and the inner ring groove 8 of the housing there is provided with a limiting clamp spring 19. A leak-down sealing region 18 for leaking the hydraulic medium is formed between the plunger lower wall 15 and the second internal cylindrical wall 17 of the housing by fitting. At the lower end of the head 11 of the plunger there is provided with an inwardly dished neck 13, i.e., the first ring groove. The neck 13 plays a role in facilitating installation of a lock piece, through which the neck is reliably connected with the roller rocker arm, to prevent a falloff.

Figure 3:
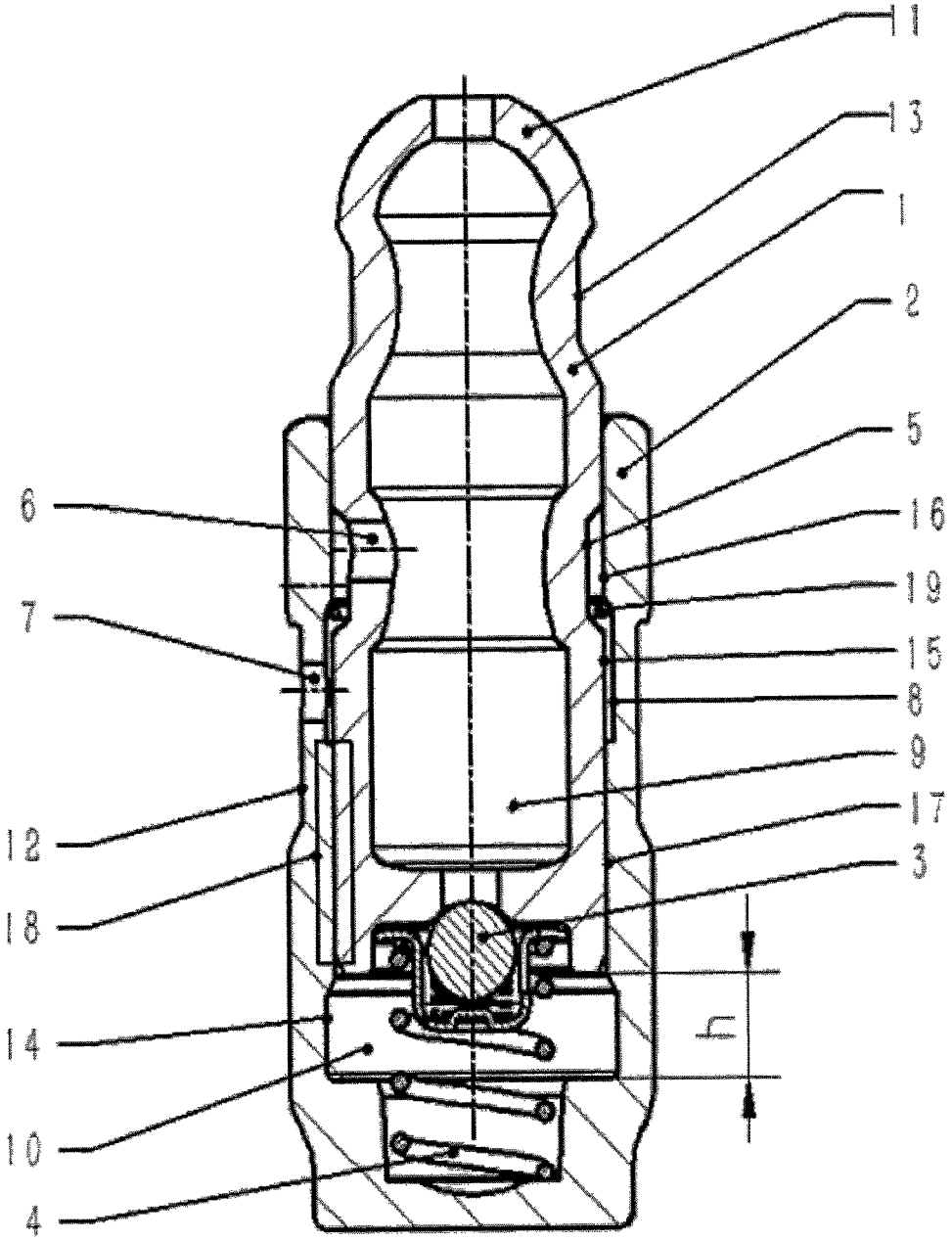
FIG. 3 is a schematic structural diagram of a hydraulic tappet according to an embodiment of the present invention when it is at a working height.

As shown in FIG. 3 and FIG. 4, the plunger has a one-piece structure, good in guiding, simple in processing technology and convenient for assembly.

The width of the grinding wheel groove of the housing is δ, the working stroke of the hydraulic tappet is h, according to a test result, δ≥h.

The length dimension a of the plunger lower wall of the plunger is larger and is not less than a sum of the width δ of the grinding wheel groove and a length L of the leak-down sealing region, i.e., a≥δ+L.

When the hydraulic tappet is at a working height, the upper end of the grinding wheel groove of the housing is not less than the lower end surface of the plunger. In the process when the plunger runs from the working height to the minimum compression height, the length L of the leak-down sealing region formed between the plunger lower wall and the second internal cylindrical wall of the housing by fitting remains unchanged basically, L is approximately equal to the length of the second internal cylindrical wall of the housing, thereby improving the leak-down stability of the hydraulic tappet in the whole working stroke.

The invention claimed is:

1. A columnar hydraulic tappet, comprising a housing, wherein a plunger that axially moves relatively to the housing is correspondingly mounted in the housing, a high-pressure chamber for a hydraulic medium extends between a lower end surface of the plunger and a lower side of the housing, and the high-pressure chamber can be sealed by means of a check valve adapted to open towards the high-pressure chamber; an outer ring groove for hydraulic medium circulation is disposed on an outer diameter of the housing, an inner ring groove for hydraulic medium circulation is disposed in a radial inner side of the housing, and one or more housing oil feed holes are disposed between the inner ring groove and the outer ring groove; a lower end inside of the housing is provided with a grinding wheel groove, an upper end wall of the inner ring groove of the housing is a first internal cylindrical wall, and a housing inner-wall between a lower end of the inner ring groove of the housing and the grinding wheel groove is a second internal cylindrical wall; a lower part of a head of the plunger is provided with a first ring groove and a middle part of the plunger is provided with a second ring groove; a plunger middle wall is disposed between the first ring groove and the second ring groove, where the second ring groove is a concave and wide ring groove, the plunger middle wall is provided with at least one oil feed hole communicated with the second ring groove, a cylindrical wall at a lower end of the concave and wide ring groove of the plunger is a plunger lower wall, and a leak-down sealing region is disposed between the second internal cylindrical wall of the housing and the plunger lower wall; and a width δ of the grinding wheel groove is not less than a working stroke height h of the plunger.

2. The columnar hydraulic tappet according to claim 1, wherein a length a of the plunger lower wall of the plunger is not less than a sum of the width δ of the grinding wheel groove and a length L of the leak-down sealing region, i.e., a≥δ+L.

3. The columnar hydraulic tappet according to claim 1, wherein when the plunger is at a working height, an upper end of the grinding wheel groove of the housing is not lower than the lower end surface of the plunger.

* * * * *